United States Patent [19]

Ogura et al.

[11] Patent Number: 4,759,861

[45] Date of Patent: Jul. 26, 1988

[54] METAL WORKING LUBRICANT

[75] Inventors: Shigetoshi Ogura; Katsumi Seki, both of Kawasaki; Hiroyuki Takashima, Yokohama, all of Japan

[73] Assignee: Nippon Oil Co., Ltd., Tokyo, Japan

[21] Appl. No.: 844,343

[22] Filed: Mar. 26, 1986

Related U.S. Application Data

[63] Continuation-in-part of Ser. No. 674,577, Nov. 26, 1984, abandoned.

[30] Foreign Application Priority Data

Nov. 29, 1983 [JP] Japan ..... 58-224963

[51] Int. Cl.[4] ..... C10M 173/00; 257 33.4

[52] U.S. Cl. ..... 252/33; 252/33.4; 252/34; 252/34.7; 252/39; 252/41; 252/49.3; 252/49

[58] Field of Search ..... 252/38, 49, 39, 49.3; 92/42; 257/33, 51.5 A, 51.5 R, 34, 33.4

[56] References Cited

U.S. PATENT DOCUMENTS

| | | | |
|---|---|---|---|
| 2,122,940 | 7/1938 | Hodsen | 252/38 |
| 3,320,164 | 5/1967 | Brinel | 252/49 |
| 3,726,799 | 4/1973 | McDole et al. | 252/49 |
| 3,784,474 | 1/1974 | Brown | 252/49 |
| 4,518,512 | 5/1985 | Kanamori | 252/38 |

FOREIGN PATENT DOCUMENTS

| | | | |
|---|---|---|---|
| 219257 | 12/1983 | Japan | 252/38 |
| 513325 | 10/1939 | United Kingdom | 252/38 |

OTHER PUBLICATIONS

Hawley, Condensed Chemical Dictionary, p. 78.

*Primary Examiner*—William R. Dixon, Jr.
*Assistant Examiner*—Cynthia A. Prezlock
*Attorney, Agent, or Firm*—Bucknam and Archer

[57] ABSTRACT

A metal working lubricant is disclosed for effective use in the working of metallic materials, particularly in cold rolling, which comprises the components of [I] an alkali metal salt, an alkaline earth metal salt, or a salt or amide of an amine or alkanolamine of a carbon number of 1 to 24, each said salt and said amide being derived from at least one acid selected from the group consisting of (1) an aliphatic mono- or di-carboxylic acid of 8 to 22 carbon atoms, or a polycarboxylic acid thereof, (2) a petroleum sulfonic acid, and (3) a naphthenic acid; [II] an alkylene glycol of the formula $HO\text{-}(C_nH_{2n}O)_m\text{-}H$ where m is an integer of 1 to 3, and n is an integer of 3 to 10; [III] water; and [IV] a mineral oil, a synthetic lubricant, a fat, a fatty oil or a combination thereof.

8 Claims, No Drawings

METAL WORKING LUBRICANT

CROSS REFERENCES TO RELATED APPLICATIONS

This application is a continuation-in-part of application Ser. No. 674,577, filed Nov. 26, 1984, now abandoned.

BACKGROUND OF THE INVENTION

1. Field of the Invention

The present invention relates to metal working lubricants and more specifically to a lubricating agent particularly but not exclusively for use in the cold rolling of metals such as steel, stainless steel, silicon steel or molybdenum steel.

2. Prior Art

Metals can be worked into desired shapes by rolling, drawing, pressing, cutting, reducing, ironing and similar working operations in which lubricants are selectively used to suit the particular application. Particularly in the manufacture of metallic sheets, there have been used two typical processes, i.e. a hot rolling and a cold rolling. A variety of lubricants have heretofore been proposed for the cold rolling of metals. Lubricants have been used even in the hot rolling of certain metals such as aluminum and its alloys. In the cold rolling operation, rolled sheets need in many cases to be subsequently annealed to prevent the sheet surfaces from being unduly hardened.

The following characteristics are those required for lubricants which may be used particularly in the cold rolling of metals.

(1) Good rolling efficiency, i.e. high oiliness and great oily film strength
(2) Excellent cooling efficiency
(3) Excellent glossing and mar resistance on finished metal surfaces
(4) High heat stability and long service life
(5) Uniform adherence to metal surfaces
(6) Easy handling and economical feasibility
(7) Oil stains or fouling reduced to absolute minimum
(8) High corrosion resistance A keen demand has been voiced for high speed cold rolling and hence increased productivity. However, such high speed operation would literally involve the generation of intense heat from friction and plastic deformation. Of the foregoing characteristics, therefore, cooling efficiency and heat stability are the most important for the cold metal working.

In the cold rolling of metals, mineral oils of low kinetic viscosity have been widely used for their superior cooling efficiency. Such mineral oils however have a drawback in that their flash point is rather low, meaning fire hazards.

In order to resolve this problem, mineral- or fat-type soluble oils have been developed from an oily material such as mineral oil of low kinetic viscosity, palm oil or beef tallow which is emulsified in water. These soluble oils take advantage of improved cooling efficiency and non-flammability owing to the presence of water. Eligible mineral-type soluble oils may be obtained for instance by mixing a mineral oil of low viscosity with an emulsifier and emulsifying the resulting mixture in water with stirring. This soluble oil however is still unsatisfactory as its lubricating capability is not sufficient and it often causes oil stain during annealing, because of the presence of various additives, particularly of a metal.

Fat-type soluble oils find wide application for their lubricating efficiency, but require repeated heating and agitation during metal working so as to maintain a uniformly emulsified condition. Furthermore, metallic products as finished require cleaning to prevent oil stain. For such cleaning, there are used alkalis, solvents, electrolytes and the like, but all this would entail added equipment and labor yet with inadequate results.

SUMMARY OF THE INVENTION

It is one object of the present invention to provide a lubricating agent which is particularly suitable for use in the cold rolling of metals such as steel and its alloys.

Another object of the invention is to provide a lubricating agent which is excellent in cooling efficiency and heat stability under high-speed rolling conditions and which features high corrosion resistance and minimum oil stain upon annealing.

These and other objects and features of the invention will appear clear from the following detailed description.

According to the invention, there is provided a lubricating agent for use in metal working which comprises the components of:

[I] 1 to 40 percent by weight of an alkali metal salt, an alkaline earth metal salt, or a salt or amide of an amine or alkanolamine of a carbon number of 1 to 24, each said salt and said amide being derived from at least one acid selected from the group consisting of (1) an aliphatic mono- or di-carboxylic acid of 8 to 22 carbon atoms, or a polycarboxylic acid thereof, (2) a petroleum sulfonic acid, and (3) a naphthenic acid;

[II] 0.1 to 20 percent by weight of an alkylene glycol of the formula $HO\text{-}(C_nH_{2n}O)_mH$ where m is an integer of 1 to 3, and n is an integer of 3 to 10;

[III] 1 to 50 percent by weight of water; and

[IV] a mineral oil, a synthetic lubricant, a fat, a fatty oil, or a combination thereof in an amount sufficient to make up the balance of the agent, wherein component [III] is present in a solubilized state in the agent.

DETAILED DESCRIPTION OF PREFERRED EMBODIMENTS

Compounds useful as component [I] in the present invention include alkali metal salts, alkaline earth metal salts, and salts and amides of amines or alkanolamines each having 1 to 24 carbon atoms, these salts and amides being derived from one or more acids which may be selected from (1) aliphatic mono- or di-carboxylic acids of 8 to 22 carbon atoms, or polycarboxylic acids thereof, (2) petroleum sulfonic acids, and (3) naphthenic acids.

The aliphatic mono- and di-carboxylic acids used as acid (1) are straight- or branched-chain, saturated or unsaturated carboxylic acids. Specific examples of such carboxylic acids include for example octanoic acid (caprilic acid), decanoic acid (capric acid), dodecanoic acid (lauric acid), tetradecanoic acid (myristic acid), hexadecanoic acid (palmitic acid), octadecanoic acid (stearic acid), eicosanic acid (arachidic acid), decosenoic acid (behenic acid), hexenoic acid, decenoic acid, dodecenoic acid, tetradecenoic acid, hexadecenoic acid, octadecenoic acid (petroselinic acid, oleic acid, elaidic acid, vaccenic acid), eicocenoic acid, docosenoic acid (erucic acid, brassidic acid), octadecatrienoic acid (linolic acid), octanedioic acid (suberic acid), nonanedioic acid (azelaic acid), decanedioic acid (sebacic acid), undecanedioic acid, dodecanedioic acid, tridecanedioic acid (brassylic acid), tetradecanedioic acid, pentadecanedioic acid, hexadecanedioic acid (thapsinic acid), heptadecanedioic acid, octadecanedioic acid, nonadecanedioic acid, eicosanedioic acid, and docosanedioic acid.

The polycarboxylic acids used as acid (1) are dimers or trimers of the mono- and di-carboxylic acids specified above. Such dimers and trimers are obtainable for example by thermal polymerization of aliphatic carboxylic acids having 8 to 22 carbon atoms and also having one or more unsaturated bonds.

The petroleum sulfonic acids used as acid (2) are mixtures of sulfonic acid and various hydrocarbons side produced by refining petroleum fractions in the presence of sulfuric acid, each of which mixtures contains an alkylaryl sulfonic acid as the chief ingredient. To be more specific, these dimers and trimers may be derived by refining petroleum fractions, particularly illuminating kerosine, in the presence of either sulfuric acid or any suitable solvent to thereby remove sludges, followed by sulfonation of the resulting fractions with fuming sulfuric acid under heated conditions and by subsequent removal of unreacted oils and waste acids from the sulfonated fractions.

The naphthenic acids used as acid (3) are saturated carboxylic acids each derived from petroleum and having a naphthenic nucleus. These carboxylic acids may be usually prepared by shaking petroleum fractions such as crude oil, kerosine, gas oil and the like with a small amount of concentrated sulfuric acid to thereby remove any basic materials, and then by extracting the resulting oily phase with aqueous sodium hydroxide or a similar alkaline solution.

The above-mentioned alkali metal, alkaline earth metal, and salts and amides of amines and alkanolamines formed from acids (1), (2) and (3) may be used either alone or in combination in the practice of the invention.

Typical examples of such alkali metal salts include lithium, sodium, potassium and rubidium salts, amongst which the sodium and potassium salts are most preferred. Typical examples of such alkaline earth metal salts include beryllium, magnesium, calcium and barium salts, and particularly preferable are the magnesium and calcium salts.

Moreover, specific examples of the amines and alkanolamines, from which salts and amides are formed as part of component [I], include methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, cyclopentylamine, cyclohexylamine, cycloheptylamine, aniline, toluidine, xylidine, dimethylamine, diethylamine, dipropylamine, dibutylamine, dipentylamine, dihexylamine, diheptylamine, dioctylamine, dinonylamine, dicyclopentylamine, diphenylamine, trimethylamine, triethylamine, tripropylamine, tributylamine tripentylamine, trihexylamine, tricyclopentylamine, tricyclohexylamine, methanolamine, ethanolamine, dipropanolamine, dimethanolamine, diethanolamine, dipropanolamine, trimethanolamine, triethanolamine, tripropanolamine, methylmethanolamine, methylethanolamine, ethylmethanolamine, ethylethanolamine, propylmethanolamine, propylethanolamine, cyclohexylmethanolamine, cyclohexylethanolamine, methyldimethanolamine, ethyldimethanolamine, propyldimethanolamine, cyclohexyldimethanolamine, methyldiethanolamine, ethyldiethanolamine, propyldiethanolamine, and cyclohexyldiethanolamine.

Of the compounds used as component [I], most preferred are the alkanolamine salts of the monocarboxylic acids of 8 to 22 carbon atoms as well as the sodium salts of the petroleum sulfonic acids.

The compounds used as component [I] in the invention should be in the range of 1 to 40 percent, preferably 5 to 30 percent based on the weight of the intended lubricating agent. Smaller amounts would result in limited range of temperatures within which to solubilize water in the lubricant. At temperatures below 0° C. the lubricant is prone to freeze and hence is not practicable. Greater amounts would lead to undue cost consumption without any significantly improved results.

Compounds useful as component [II] in the invention are alkylene glycols represented by the formula $HO\text{-}(C_nH_{2n}O)_m\text{-}H$ where m is an integer of 1 to 3, and n is an integer of 3 to 10. Greater integers of m would adversely affect transparency and stability of the lubricant. Smaller integers of n would lead to limited ranges of temperatures within which to solubilize water in the lubricant, resulting in deteriorated lubricating effeciency, and greater integers would lead to unstability of the lubricant. Typical examples of the alkylene group having the formula $-C_nH_2n-$ include, propylene, butylene, pentylene, hexylene, trimethylene, tetramethylene, pentamethylene, hexamethylene and 1,1,3-trimethyltrimethylene groups. Such alkylene group may also be one in which an alkylene group of a varied carbon number is present in one molecule. Particularly preferred are propylene glycol, dipropylene glycol, hexylene glycol, 2-methyl-2,4-pentanediol and combinations thereof.

The compounds used as component [II] in the invention should be in the range of 0.1 to 20 percent, preferably 1 to 10 percent based on the weight of the lubricating agent. Smaller amounts would render it impossible to homogeneously solubilize water in the lubricant, resulting in reduced lubricating efficiency. Greater amounts would adversely affect uniform dissolution of component [II] in the lubricant.

Component [III] used in the invention is water which should be in the range of 1 to 50 percent, preferably 10 to 40 percent based on the weight of the lubricating agent. Amounts above 35 percent by weight are particularly desirable since the lubricant gives rise to higher non-flammability. Smaller amounts would deteriorate cooling efficiency and would otherwise induce seizing. Greater amounts would make it difficult to homogeneously solubilize component [III] in the lubricant.

Oily materials useful as component [IV] in the invention are mineral oils, synthetic lubricants, fats, fatty oils, and mixtures thereof. Such mineral oils, synthetic lubricants, fats and fatty oils each may have a kinetic viscosity of 1.5 to 30 cst at 40° C.

The oily materials used as component [IV] in the invention are in amounts sufficient to make up the balance of the lubricant product.

Preferred examples of the mineral oils are pure mineral oils resulting from purification of lubricating oil fractions by commonly employed techniques such for example as solvent purification, sulfuric acid treatment, hydrogenation purification, clay treatment and a combination thereof.

Typical examples of the synthetic lubricants may be those known in the art and may be selected from higher alcohols, ester oils, poly-alpha-olefin oils, and alkylated aromatic hydrocarbons. Specific examples of such lubricants include aliphatic monohydric alcohols of 8 to 22 carbon atoms such as dodecyl alcohol and lauryl alcohol, esters of aliphatic monocarboxylic acids of 10 to 22 carbon atoms such as methyl laurate and butyl stearate and aliphatic monohydric alcohols of 1 to 10 carbon atoms, diesters of dibasic acids such as di-alpha-ethylhexyl sebacate and monohydric alcohols, esters of polyhydric alcohols such as trimethylpropane caprylate, poly-alpha-olefin oils resulting from homo- or copolymerization of alpha-olefins of 4 to 14 carbon atoms, and alkylbenzenes and alkylnaphthalenes substituted with straight- or branched-chain alkyl groups.

Typical examples of the fats and fatty oils may be of animal or vegetable origin and include tallow, lard, tallow-seed oil, fish oil, whale oil and cod-liver oil of animal origin, and coconut oil, castor oil, rape oil, palm oil and soybean oil of vegetable origin.

The lubricating agent of the invention generally comprises the combination of components [I], [II], [III] and [IV]. Where it is found suitable, the lubricant may be incorporated with conventional additives such as oiliness improvers, extreme-pressure lubricants, antioxidants, bactericides, antiseptics and the like. Such additives may be used either alone or in combination and should be in the range of 15 percent or smaller, preferably 10 percent or smaller based on the weight of the lubricating agent.

The lubricating agent according to the invention may be produced by admixing components [I], [II], [III] and [IV], if necessary, together with the aforesaid additives, and agitating and homogenizing the resulting mixture, whereby component [III] is fully solubilized in the finished lubricant. Component [III] can be easily solubilized into components [I], [II] and [IV] using conventional agitating techniques.

By the term "solubilization" or synonymous expression as used herein is meant the manner in which water is homogeneously dissolved in the other oily components, thereby providing a transparent solution. It is to be noted therefore that "solubilization" is construed as being physicochemically different from "emulsification" in which a turbid solution is prepared with water dispersed but remaining as droplets in an oily phase.

It has also been found that the lubricating agent of the invention is adequately applicable not only to the cold rolling of metals but also to other metal working operations including hot rolling, grinding, drawing, pressing, cutting, reducing, iroing and the like, among which a grinding operation is particularly noted. There is no restriction imposed upon the use of such lubricant solely in the cold rolling of metals.

The following example is given to further illustrate the present invention, but it is to be understood that the invention is not limited thereto.

EXAMPLE

Six lubricants were formulated as shown in Table 1 (inventive lubricants 1 to 6).

For comparative purposes, seven lubricants were prepared, the formulations of which were given in Table 2 (comparative lubricants 1 to 7). Such comparative lubricants were (1) an emulsion containing 10 percent by weight of a commercially available, emulsifiable rolling oil, (2) a lubricant resulting from dispersing pure palm oil in water, (3) a mineral-type rolling oil similar to a commercial mineral-type lubricating oil, (4) a lubricant formulated in the same manner as in inventive lubricant 1 except for the omission of component [II], (5) a lubricant formulated in the same manner as in inventive lubricant 2 except for the omission of component [II], (6) a lubricant similar to comparative lubricant 4 but using a nonionic surface active agent as component [I], and (7) a lubricant similar to inventive lubricants 4 to 6 but using diethylene glycol as component [II].

These inventive and comparative lubricants were evaluated with respect to both the rolling performance and the water-solubilizing ability.

1. Rolling Performance

Inventive lubricants 1 to 6 and comparative lubricants 1, 2, 3 and 7 were applied to rolls in the rolling of metallic plates so as to determine the rolling loads under one and the same rate of pressure drop as well as the glosses and mars on the surfaces of the plates thus worked. Gloss determination was made by measuring the reflectance on the plate surfaces using an SM color computer (made by Suga Test Instruments Co., Ltd., Japan), while marring on the plate surfaces was adjudged visually.

Roll Specification
- Work roll diameter: 50 mm
- Rolling speed: 40 m/minute
- Pressure drop: 35%

Rolling Metal
- Rolled piece: 18-8 stainless steel plate
- Plate thickness: 0.3 mm
- Plate width: 50 mm The results obtained are shown in Table 3.

In contrast to the mineral-type rolling oil (comparative lubricant 3), inventive lubricants 1 to 3 effectively protect the rolled plate surfaces from being marred. This is attributable to the fact that component [III], i.e. water, has become fully solubilized in each of the inventive lubricants. Moreover, each inventive lubricant possesses a reduced rolling load. It is believed that when such inventive lubricant is circulated into the roll bite, the water solubilized in the lubricant may aid as a coolant and hence may cool the contact area between the steel plate being worked and the rolls with least seizing.

The emulsion-type rolling oil (comparative lubricant 1) offers good cooling efficiency imparted by the water present in such emulsion. However, this type of rolling oil would fail to allow an oily component to be satisfactorily circulated into the roll bite, giving rise to increased marring on the metal plate surface.

As is well known in the art, palm oil finds extensive application to the cold rolling of metallic pieces. The palm oil-containing lubricant (comparative lubricant 2) is superior in rolling properties (reduced loads) and mar resistance, but suffers from substantially diminished glossing on the plate surface.

As is apparent from the results in Table 3, the lubricants embodying the present invention exhibit excellent rolling properties, and improved glossing and mar resistance on metal plate surfaces. The conventional lubricant containing diethylene glycol as component [II] (comparative lubricant 7) is not satisfactory in respect of rolling properties and mar resistance.

2. Water-solubilizing Ability

Inventive lubricants 1 to 3 and comparative lubricants 4 to 7 were subjected to varied temperature conditions to observe the range of temperatures within which water as component [III] was solubilized in each lubricant to thereby provide a substantially transparent solution.

The results obtained are shown in Table 4.

Water can be solubilized in comparative lubricants 4, 5 and 7 as well as in comparative lubricant 6 when using greater amounts of a nonionic surface active agent as component [I]. In these instances, however, such water solubilization is possible only in a limited temperature range of 18° to 55° C.

As is apparent from the results in Table 4, the lubricants embodying the present invention are kept in water-solubilized form over a wider temperature range of 10° to 95° C. and therefore are easy to handle like conventional mineral-type rolling oils.

TABLE 1

| Inventive lubricant | Formulation (percent by weight) | | | |
|---|---|---|---|---|
| | Component [I] | Component [II] | Component [III] | Component [IV] |
| 1 | Salt of oleic acid and N,N—dicyclohexylethanolamine (20) | Dipropylene glycol (4) | Distilled water (20) | Pure mineral oil of a kinetic viscosity of 6.5 cst at about 40° C. (56) |
| 2 | Salt of oleic acid and diethanolamine (22) | 2-Methyl-2,4-pentanediol (7) | Distilled water (40) | Pure mineral oil of a kinetic viscosity of 1.7 cst at about 40° C. (31) |
| 3 | Sodium salt of a petroleum sulfonic acid (6) | Propylene glycol (2) | Distilled water (3) | Pure mineral oil of a kinetic viscosity of 14.5 cst at about 40° C. (74) Butyl stearate (15) |
| 4 | Salt of oleic acid and N.N—dicyclohexylethanolamine (20) | Dipropylene glycol (2) | Distilled water (10) | Pure mineral oil of a kinetic viscosity of 5.0 cst at about 40° C. (56) Butyl stearate (7) Lauryl alcohol (5) |
| 5 | Salt of Oleic acid and N,N—dicyclohexylethanolamine | Hexylene glycol (2) | Distilled water (10) | Pure mineral oil of a kinetic viscosity of 5.0 cst at about 40° C. (56) Butyl Stearate (7) Lauryl alcohol (5) |
| 6 | Salt of oleic acid and N,N—dicyclohexylethanolamine | 2-Methyl-2,4-pentanediol (2) | Distilled water (10) | Pure mineral oil of a kinetic viscosity of 5.0 cst at about 40° C. (56) Butyl stearate (7) Lauryl alcohol (5) |

TABLE 2

| Comparative lubricant | Formulation (percent by weight) | | | |
|---|---|---|---|---|
| | Component [I] | Component [II] | Component [III] | Component [IV] |
| 1 | Emulsion containing 10 percent by weight of a commercially available, emulsifiable rolling oil | | | |
| 2 | — | — | Distilled water (90) | Pure palm oil (10) |
| 3 | — | — | — | Mineral oil of a kinetic viscosity of 14.5 cst at about 40° C. (85) Butyl stearate (15) |
| 4 | Salt of oleic acid and N,N—dicyclohexylethanolamine (20) | — | Distilled water (20) | Mineral oil of a kinetic viscosity of 6.5 cst at about 40° C. (38) |
| 5 | Salt of oleic acid and diethanolamine (22) | — | Distilled water (40) | Mineral oil of a kinetic viscosity of 1.7 cst at about 40° C. (63) |
| 6 | Nonyl phenyl ether of ethylene oxide of a nonionic surface active agent type (20) | — | Distilled water (17) | Mineral oil of a kinetic viscosity of 6.5 cst at about 40° C. (63) |
| 7 | Salt of oleic acid and N,N—dicyclohexylethanolamine (20) | Diethylene glycol (2) | Distilled water (10) | Pure mineral oil of a kinetic viscosity of 5.0 cst at about 40° C. (56) Butyl stearate (7) Lauryl alcohol (5) |

TABLE 3

| Lubricant | Rolling load (ton) | Gloss on plate surface (reflectance %) | Mar on plate surface |
|---|---|---|---|
| Inventive lubricant 1 | 12.0 | 68 | None |
| Inventive lubricant 2 | 12.5 | 72 | None |
| Inventive lubricant 3 | 8.8 | 65 | None |
| Inventive lubricant 4 | 12.0 | 70 | None |
| Inventive lubricant 5 | 12.2 | 69 | None |
| Inventive Lubricant 6 | 12.5 | 72 | None |
| Comparative lubricant 1 | 25.0 | 45 | Greater |
| Comparative lubricant 2 | 9.0 | 30 | None |
| Comparative lubricant 3 | 13.0 | 60 | Smaller |
| Comparative lubricant 7 | 17.2 | 58 | Smaller |

TABLE 4

| Lubricant | Solubilization temperature (°C.) |
|---|---|
| Inventive lubricant 1 | −10–+95 |
| Inventive lubricant 2 | 0–+80 |
| Inventive lubricant 3 | −5–+95 |
| Inventive lubricant 4 | 0–+90 |
| Inventive lubricant 5 | −5–+95 |
| Inventive lubricant 6 | −5–+95 |
| Comparative lubricant 4 | +20–+55 |
| Comparative lubricant 5 | +25–+42 |
| Comparative lubricant 6 | +18–+35 |
| Comparative lubricant 7 | +40–+95 |

What is claimed is:

1. A lubricating agent for use in metal working which consists of:

Component (I) which is 1 to 40 percent by weight of a salt or an amide of an acid which is a member selected from the group consisting of (a) an aliphatic mono- or di-carboxylic acid of 8 to 22 carbon atoms;

(b) a dimer or a trimer of said aliphatic mono- or di-carboxylic acid defined in (a) hereinabove (c) a petroleum sulfonic acid, and (d) a naphthenic acid; said salt being with an alkali metal, an alkaline earth metal, or with an amine or alkanolamine of 1–24 carbon atoms, said amide being with an amine or alkanolamine of 1–24 carbon atoms;

Component (II) which is 0.1 to 20 percent by weight of an alkylene glycol of formula $HO-(C_nH_{2n}O)_m-H$ where m is an integer of 1 to 3, and n is an integer of 3 to 10;

Component (III) which is 1 to 50 percent by weight of water; and

Component (IV) which is a mineral oil, a synthetic lubricant, a fat, a fatty oil, or a combination thereof in an amount sufficient to make up the balance of the agent, wherein component (III) is present in a solubilized state in the agent.

2. The lubricating agent according to claim 1 wherein said aliphatic mono- and di-carboxylic acids are straight- or branched-chain, saturated or unsaturated carboxylic acids, said petroleum sulfonic acid is a mixture of sulfonic acid and a hydrocarbon resulting from petroleum refining, said mixture being chiefly composed of an alkylaryl sulfonic acid, and said naphthenic acid is a saturated carboxylic acid derived from petroleum and having a napthenic nucleus.

3. The lubricating agent according to claim 2 wherein said aliphatic mono- and di-carboxylic acids are selected from the group consisting of octanoic acid, decanoic acid, dodecanoic acid, tetradecanoic acid, haxadecanoic acid, octadecanoic acid, eicosanic acid, docosanic acid, hexenoic acid, decenoic acid, dodecenoic acid, tetradecenoic acid, hexadecenoic acid, octadecenoic acid, eicosenoic acid, docosenoic acid, octadecatrienoic acid, octanedioic acid, nonanedioic acid, decanedioic acid, undecanedioic acid, dodecanedioic acid, tridecanedioic acid, tetradecanedioic acid, pentadecanedioic acid, hexadecanedioic acid, heptadecanedioic acid, octadecanedioic acid, nonadecanedioic acid, eicosanedioic acid, and docosanedioic acid.

4. The lubricating agent according to claim 1 wherein said alkali metal salt is selected from the group consisting of lithium, sodium, potassium and rubidium salts, said alkaline earth metal salt is selected from the group consisting of beryllium, magnesium, calcium and barium salts, and said amine and alkanolamine are selected from the group consisting of methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, cyclopentylamine, cyclohexylamine, cycloheptylamine, aniline, toluidine, xylidine, dimethylamine, diethylamine, dipropylamine, dibutylamine, dipentylamine, dihexylamine, diheptylamine, dioctylamine, dinonylamine, dicyclopentylamine, diphenylamine, trimethylamine, triethylamine, tripropylamine, tributylamine, tripentylamine, trihexylamine, tricyclopentylamine, tricyclohexylamine, methanolamine, ethanolamine, dipropanolamine, dimethanolamine, diethanolamine, dipropanolamine, trimethanolamine, triethanolamine, tripropanolamine, methylmethanolamine, methylethanolamine, ethylmethanolamine, ethylethanolamine, propylmethanolamine, propylethanolamine, cyclohexylmethanolamine, cyclohexylethanolamine, methyldimethanolamine, ethyldimethanolamine, propyldimethanolamine, cyclohexyldimethanolamine, methyldiethanolamine, ethyldiethanolamine, propyldiethanolamine, and cyclohexyldiethanolamine.

5. The lubricating agent according to claim 1 wherein said alkylene glycol is selected from the group consisting of propylene glycol, dipropylene glycol, hexylene glycol, 2-methyl-2,4-pentanediol and combinations thereof.

6. The lubricating agent according to claim 1 wherein said mineral oil is in pure form, said synthetic lubricant is a higher alcohol, an ester oil, a poly-alpha-olefin oil or an alkylated aromatic hydrocarbon, and said fat and fatty oil are of animal or vegetable origin.

7. The lubricating agent according to claim 6 wherein said synthetic lubricant is selected from the group consisting of aliphatic monohydric alcohols of 8 to 22 carbon atoms, esters of aliphatic monocarboxylic acids of 10 to 22 carbon atoms and aliphatic monohydric alcohols of 1 to 10 carbon atoms, diesters of dibasic acids and polymonohydric alcohols, esters of polyhydric alcohols, poly-alpha-olefin oils resulting from homo- or co-polymerization of alpha-olefins of 4 to 14 carbon atoms, and alkylbenzenes and alkylnaphthalenes substituted with straight- or branched-chain alkyl groups, and said fat and fatty oil are selected from the group consisting of tallow, lard, tallow-seed oil, fish oil, whale oil, cod-liver oil, olive oil, coconut oil, castor oil, rape oil, palm oil, and soybean oil.

8. A process for producing a lubricating agent for use in metal working which consists of the steps of: admixing components (I), (II), (III), and (IV), Component (I) consisting of 1 to 40 percent by weight of a salt or an amide of an acid which is a member selected from the group consisting of (a) an aliphatic mono- or di-carboxylic acid of 8 to 22 carbon atoms (b) a dimer or a trimer of said aliphatic mono- or di-carboxylic acid defined in (a) hereinabove, (c) a petroleum sulfonic acid, and (d) a naphthenic acid;

said salt being with an alkali metal, an alkaline earth metal, or with an amine or alkanolamine of 1–24 carbon atoms, said amide being with an amine or alkanolamine of 1–24 carbon atoms;

Component (II) being 0.1 to 20 percent by weight of an alkylene glycol of formula $HO-(C_nH_{2n}O)_mH$ where m is an integer of 1 to 3, and n is an integer of 3 to 10;

Component (III) being 1 to 50 percent by weight of water; and

Component (IV) being a mineral oil, a synthetic lubricant, a fat, a fatty oil, or a combination thereof in an amount sufficient to make up the balance of the agent;

agitating and homogenizing the resulting mixture, whereby component (III) is caused to solubilize in the agent.

* * * * *